United States Patent [19]

Arfons

[11] 4,092,789

[45] June 6, 1978

[54] MOBILE DIRECTIONAL HIGH VELOCITY AIR MOVING APPARATUS

[76] Inventor: Jon Craig Arfons, 2999 Northview, Uniontown, Ohio 44685

[21] Appl. No.: 751,981

[22] Filed: Dec. 20, 1976

[51] Int. Cl.[2] ..... E01H 5/10

[52] U.S. Cl. ..... 37/12; 15/340; 239/502; 37/19; 126/343.5 R; 126/271.1

[58] Field of Search ..... 37/12, 14, 19; 126/271.1, 271.2 R, 271.2 A; 15/340, 419–422; 239/502, 503, 505, 507, 462

[56] References Cited

U.S. PATENT DOCUMENTS

| | | | |
|---|---|---|---|
| 2,789,804 | 4/1957 | Toulmin, Jr. | 37/19 X |
| 2,896,246 | 7/1959 | Wildt | 126/271.1 X |
| 3,041,478 | 7/1962 | Wetzel | 15/340 X |
| 3,099,097 | 7/1963 | Simmons | 37/19 |
| 3,136,488 | 6/1964 | Petlak et al. | 37/12 X |
| 3,199,506 | 8/1965 | Bertin et al. | 37/12 X |
| 3,228,125 | 1/1966 | Wiebe | 15/340 X |
| 3,359,969 | 12/1967 | Bertin et al. | 37/12 X |
| 3,493,989 | 2/1970 | Karijo | 37/12 X |
| 3,745,700 | 7/1973 | Hahn | 37/12 X |

FOREIGN PATENT DOCUMENTS

| | | | |
|---|---|---|---|
| 1,191,114 | 10/1959 | France | 37/19 |
| 271,549 | 5/1970 | U.S.S.R. | 37/12 |
| 363,779 | 2/1973 | U.S.S.R. | 37/12 |

*Primary Examiner*—E. H. Eickholt

*Attorney, Agent, or Firm*—Hamilton, Renner & Kenner

[57] ABSTRACT

Apparatus for directionally controlling the movement of high velocity air in relation to a work surface including a mobile support frame, a jet engine having an elongate tubular housing attached to the support frame, an air intake at one axial extremity of the tubular housing, a tail pipe at the other axial extremity of the tubular housing, an intake duct attached to the air intake, and an exhaust duct mounted proximate the tail pipe for directing high velocity air into impingement with the work surface.

17 Claims, 6 Drawing Figures

MOBILE DIRECTIONAL HIGH VELOCITY AIR MOVING APPARATUS

BACKGROUND OF THE INVENTION

The present invention relates generally to apparatus suitable for utilization in the construction and maintenance industries. More particularly, the present invention relates to apparatus operable in conjunction with a jet engine to effect large scale operations involved in construction, maintenance and related service industries. More specifically, the invention relates to jet engine powered apparatus which controls the flow of air to and the exhausting of expanded high speed, high temperature air to effect removal of moisture and debris of various types and to effect controlled moisture drying, snow removal, vegetation burning and comparable functions.

Historically, the construction industry, certain maintenance and service industries, and certain outdoor recreational industries have been highly dependent upon naturally occurring weather conditions. In this respect, many construction activities have been deemed impossible particularly in freezing weather or extreme snow or moisture conditions at a work site, e.g., construction involving the application of asphalt is dependent upon road bed temperature conditions exceeding the freezing point and excessive ground moisture occasionally produces sufficient mud or water such as to render the use of heavy equipment impossible. In the maintenance and service industries, the removal of snow from airport runways, railway tracks and other large areas has presented extreme problems which previously have been solvable only by the usage of extreme manpower with available equipment over extended time periods. In the recreational field, race tracks are frequently rendered extremely dangerous or unusable due to moisture conditions even substantial time periods prior to scheduled events such as to preclude usage.

In recent years, peripheral factors have brought significant pressure to bear with respect to the possibility of sufficiently altering naturally existing weather conditions to permit the continuation of such activities, at least to a limited localized extent. These peripheral factors include such considerations as the high cost of maintaining a large construction crew although work can only be accomplished on a part-time basis, particularly during certain periods of the year, and the necessity for meeting stringent contractual deadlines in completing construction activities or being subject to severe penalties. In the maintenance and servicing fields, air ports, railways and other facilities can be virtually shut down for varying time periods in cases of extreme snow fall such as to cause substantial operating losses and customer inconvenience. In the recreation field various racing events of all types are scheduled substantially in advance such that all feasible efforts must be exerted even to the point of conducting events on other than dry surfaces in order to avoid cancellations or delays.

As a result of increasing pressures from these peripheral factors, some efforts have been made to develop apparatus which is capable of altering outdoor environmental conditions in relation to the above-discussed industries. To date, these efforts have largely contemplated a combined use of burners operating in conjunction with a blower system. Such apparatus has generally contemplated the ignition of diesel fuel, propane or crude oil in conjunction with a blower system which tends to direct heated air for purposes of drying, snow removal, moisture extraction and related operations. In general, however, the capability of systems of this nature has been limited to situations where only minor alterations in environmental conditions are required due to the limited capability of such systems and their relatively high expense. Altogether, such systems have been sufficiently limited in these respects such that they have not succeeded in gaining any sufficient extent of acceptance and usage in the industries involved.

SUMMARY OF THE INVENTION

Therefore, an object of the present invention is to provide high velocity air dispensing apparatus which is capable of meeting the operational requirements of the construction industries, certain maintenance and service industries and certain outdoor recreational industries. Another object of the invention is to provide such apparatus which is capable of a multitude of uses in such industries, including snow removal, moisture drying and heating of road surfaces and bridge sites in the construction industry; snow and ice removal from runways or other extensive surfaces and vegetation burning in the maintenance and service industries; and the removal of debris and moisture from race tracks and other large surfaces in recreational industries. A further object of the present invention is to provide such apparatus which employs a conventional jet engine as the source of high velocity heated air.

Still another object of the invention is to provide such apparatus on a mobile platform which may be individually selfpropelled or towable by a truck or other powered vehicle. A further object of the invention is to provide such apparatus having an exhaust duct which directs high velocity air on a work surface. Yet another object of the invention is to provide such apparatus wherein the exhaust duct has an outlet of sufficient size to distribute heated high velocity air substantially uniformly over a substantial surface area such as to permit effective moving operation of the apparatus. Yet a further object of the invention is to provide such apparatus having an intake duct for a jet engine which projects substantially upwardly above the axial dimensions of the engine such as to insure a relatively clean air input for the engine irrespective of the presence of dust, dirt and other contaminants near the ground surface; an alternative embodiment of the intake duct according to the concept of the present invention has a duct inlet positioned proximate the work surface coupled with a baffling arrangement for purposes of maximizing the extraction of moisture from intake air together with a fluid collection tank, and, optionally, a pump and suitable conduits for transferring liquid condensate to the exhaust system for disposal as steam. Still another object of the present invention is to provide apparatus wherein a screening device may be provided in the intake duct of sufficient size to preclude entry of objects of sufficient size and density to damage internal components of the jet engine.

Still a further object of the invention is to provide such apparatus wherein at least the exhaust duct is flexibly mounted with respect to the engine to preclude serious damage thereto in the event of minor collisions with other vehicles or obstacles. Still a further object of the invention is to provide such apparatus which is sufficiently rugged to withstand the outdoor environment over substantial periods of time and the rigors of rough usage inherent in the environment. A still further object of the invention is to provide such apparatus which is relatively inexpensive and efficient in relation to the work capability of the apparatus.

These and other objects, together with the advantages thereof over existing and prior art forms which will become apparent from the following specification, are accomplished by the means hereinafter described and claimed.

In general, apparatus for directionally controlling the movement of high velocity air in relation to a work surface according to the concepts of the present invention contemplates a mobile support frame, a jet engine having an elongate tubular housing attached to the support frame, an air intake at one axial extremity of the tubular housing, a tail pipe at the other axial extremity of the tubular housing, an intake duct attached to the air intake, and an exhaust duct mounted proximate the tail pipe and directing high velocity air into impingement with the work surface.

DESCRIPTION OF THE PREFERRED EMBODIMENT

Figure 1:
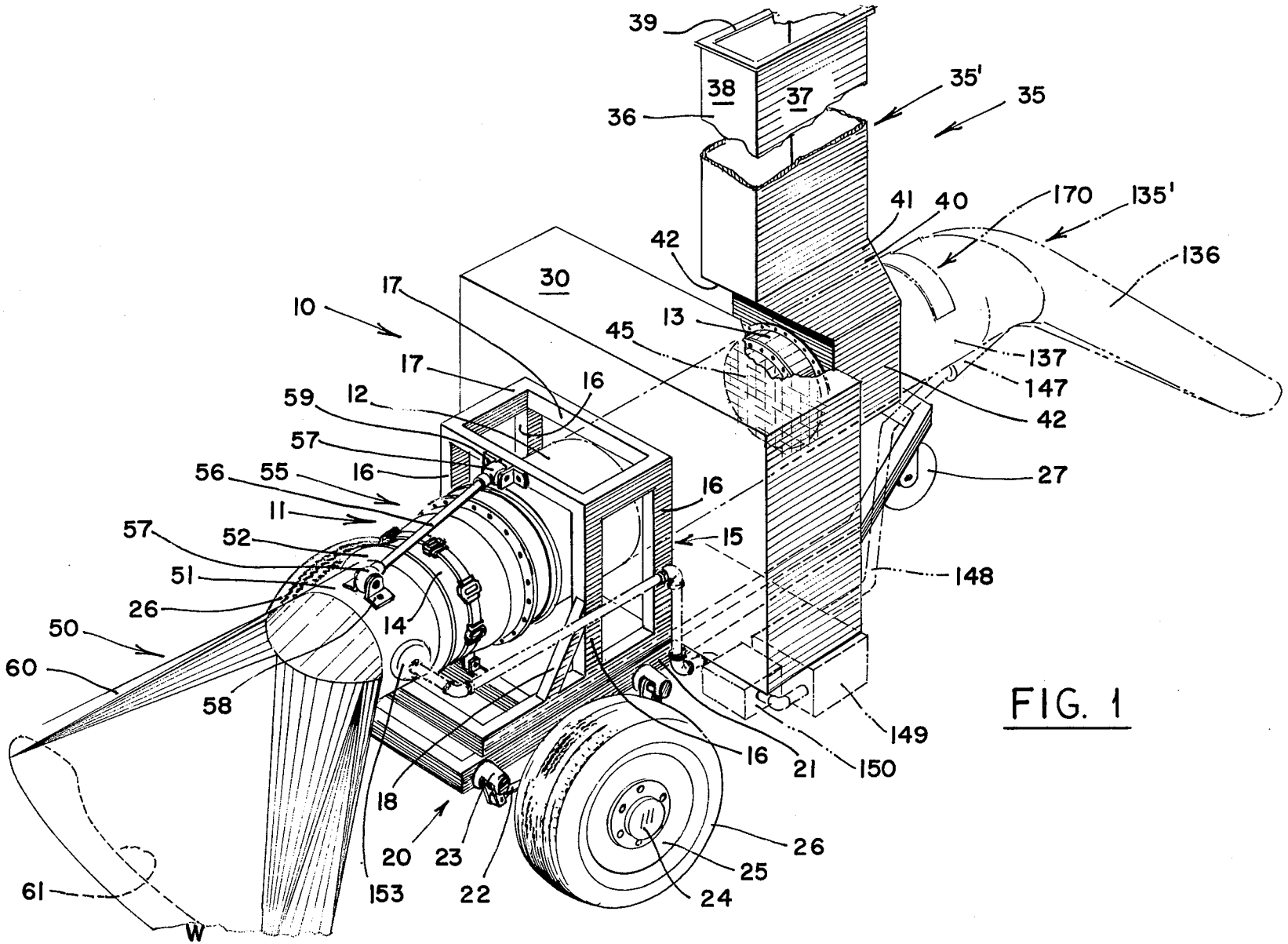
FIG. 1 is a fragmentary perspective view with portions broken away of apparatus embodying the concepts of the present invention and generally depicting a movable frame mounted jet engine with an exhaust duct and an intake duct and further depicting an alternate form of the intake duct and associated components depicted in chain lines.
Figure 2:
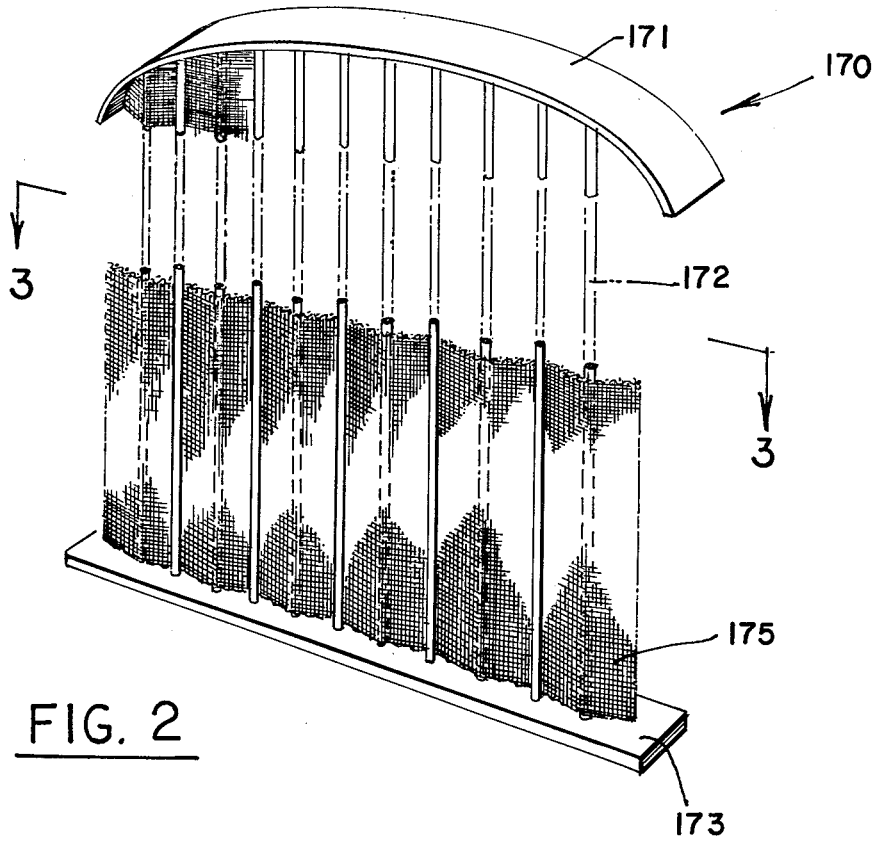
FIG. 2 is a perspective view of a debris accumulator designed for incorporation in the alternate form of the intake duct depicted in FIG. 1 of the drawings and shown removed therefrom.
Figure 3:
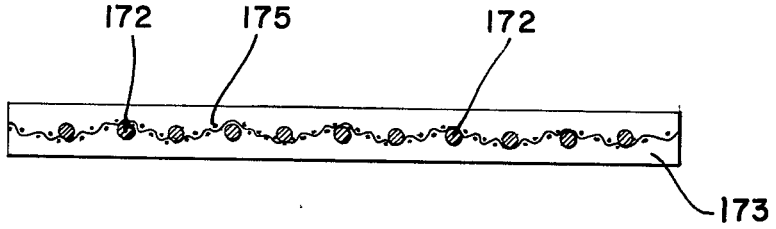
FIG. 3 is a section view of the debris accumulator taken substantially along the line 3—3 of FIG. 2 of the drawings.

A mobile directional high velocity air moving apparatus according to the concept of the present invention is generally indicated by the numeral 10 in FIG. 1 of the attached drawings. The motive force creating the high velocity air for the apparatus 10 is a jet engine, generally indicated by the numeral 11. Although various types of jet engines might be adaptable for use in the apparatus 10, the inherent operational characteristics and advanced design status of turbojet engines make them particularly adaptable for the present type of application. In particular, the Lycoming T-53 and the Westinghouse J-34 constitute two examples of turbojet engines which are known to be suitable to apparatus of this type.

Whatever may be the particular engine 11 selected, each would have in common the characteristics of an elongate tubular housing 12 containing a compressor, combustion chamber, turbine and other conventional components of a turbojet engine well known to persons skilled in the art. The elongate tubular housing 12 has, at one axial extremity thereof, an air intake portion 13 which encloses and/or communicates with the diffuser portion of engine 11. The other axial extremity of the tubular housing 12 encloses a tail pipe portion 14 of the engine 11.

The engine 11 is mounted to an upstanding frame, generally indicated by the numeral 15, preferably by rigid attachment thereof. Although the frame 15 could take a variety of forms, a regular polygonal configuration having a plurality of vertical supports 16 separated by horizontal spacers 17 and reinforced by angle struts 18, as seen in FIG. 1, constitutes a preferred form in terms of strength and simplicity.

Although the upstanding frame could be mounted on a self-powered vehicle, the embodiment shown contemplates the use of a trailer, generally indicated by the numeral 20, or other wheeled vehicle for purposes of imparting mobility to the apparatus 10. As shown, the trailer 20, has an elongate chassis 21 which may be conveniently, at least in the instance of an engine 11 of substantial length, generally parallel the elongate tubular housing 12 of the engine 11. The upstanding frame 15 reposes atop the chassis 21 and is suitably attached thereto as by welding (not shown). Mounted in any number of conventional forms with respect to the chassis 21, the trailer 20 has running gear which may consist of springs 22 which are retained in spring mounts 23 on chassis 21 and an axle 24 attached to the springs 22 and running transversely of the chassis 21 to which suitable wheels 25 and tires 26 are fitted.

For stability when the trailer 20 is demounted from a powered vehicle, the chassis 21 may be provided with a conventional retractable dolly wheel 27 which is adapted to maintain the chassis 21 substantially parallel to the ground in a manner well known to persons skilled in the art. The chassis 21, in addition to carrying the upstanding frame 13, also preferably carries a fuel tank 30 which provides the requisite fuel requirements for the engine 11 over a suitable operating period. For purposes of minimizing the size of the tank 30 and particularly its extent of extension laterally of the trailer 20, the tank may be configured to fit around the engine 11.

For purposes of channeling air from an appropriate source location to the intake air portion 13 of engine 11 the apparatus 10 is provided with an intake duct, generally indicated by the numeral 35. As seen in FIG. 1 of the drawings, an exemplary intake duct for certain applications is shown in solid lines in the form of an intake stack, generally indicated by the numeral 35'. The intake stack 35' is particularly adaptable to applications where it is advantageous that input air be extracted a substantial distance above the ground as, for example, in construction sites where there is commonly dust, dirt and other pollutants entrained in air near the ground. As shown, the intake stack 35' has an upper chimney section 36 which may be of generally rectangular cross-sectional area, preferably with opposed elongate sides 37 spaced and joined by opposed short sides 38. The rather elongate rectangular cross-section area has been found to be advantageous in that turbine whine normally associated with jet engines is reduced substantially without effecting the operational characteristics of engine 11 in a significantly adverse manner. In addition, such an elongate rectangular configuration, if the elongate side thereof is oriented longitudinally of the trailer 20, provides minimal obstruction to the operator of a powered vehicle towing the trailer 20 during operation.

The upper extremity of chimney section 36 terminates in an elongate rectangular opening defined by the sides 37, 38 and may be bounded by a reinforcing flange 39 of identical configuration. Since the intake stack 35' is conveniently constructed of sheet metal material, and preferably stainless steel to provide optimum resistance to environmental conditions, the reinforcing flange 39 is significant in preventing possible inward deflection of the upper extremities of sides 37, 38 which could be caused by the rapid rush of air downwardly within the chimney section 36 when the engine 11 is energized and the related vacuum-forming tendencies produced by such rapid, voluminous air displacement.

Below the chimney section 36 the intake stack 35' has a transition section 40 which has beveled surfaces 41 and 42 which merge into a generally cylindrical section 42 of the intake stack 35'. The cylindrical section 42 is configured for attachment to and sized equivalent to the air intake portion 13 of tubular housing 12. Although a wide variety of configurations of the various sections of the intake stack 35' would be possible, it is significant to attain desirable air flow and noise characteristics that each of the chimney, transition, and cylindrical sections, 36, 40 and 42, respectively, be of substantially constant cross-sectional area perpendicular to the direction of air flow therethrough, which cross-sectional area constitutes the size of the air intake portion 13 of the tubular housing 12 of engine 11.

Although the intake stack 35' would normally be of sufficient height to preclude entry of any foreign matter of sufficient size to internally damage a jet engine, the well known possible disintegration of engine components in such event makes it desirable to provide added assurance against the entry of foreign matter of any substantial size. To this end, a wire mesh or screen 45 may be inserted somewhere in the intake stack 35' and conveniently at the juncture between cylindrical section 42 and the air intake portion 13 of the tubular housing 12.

Figure 4:
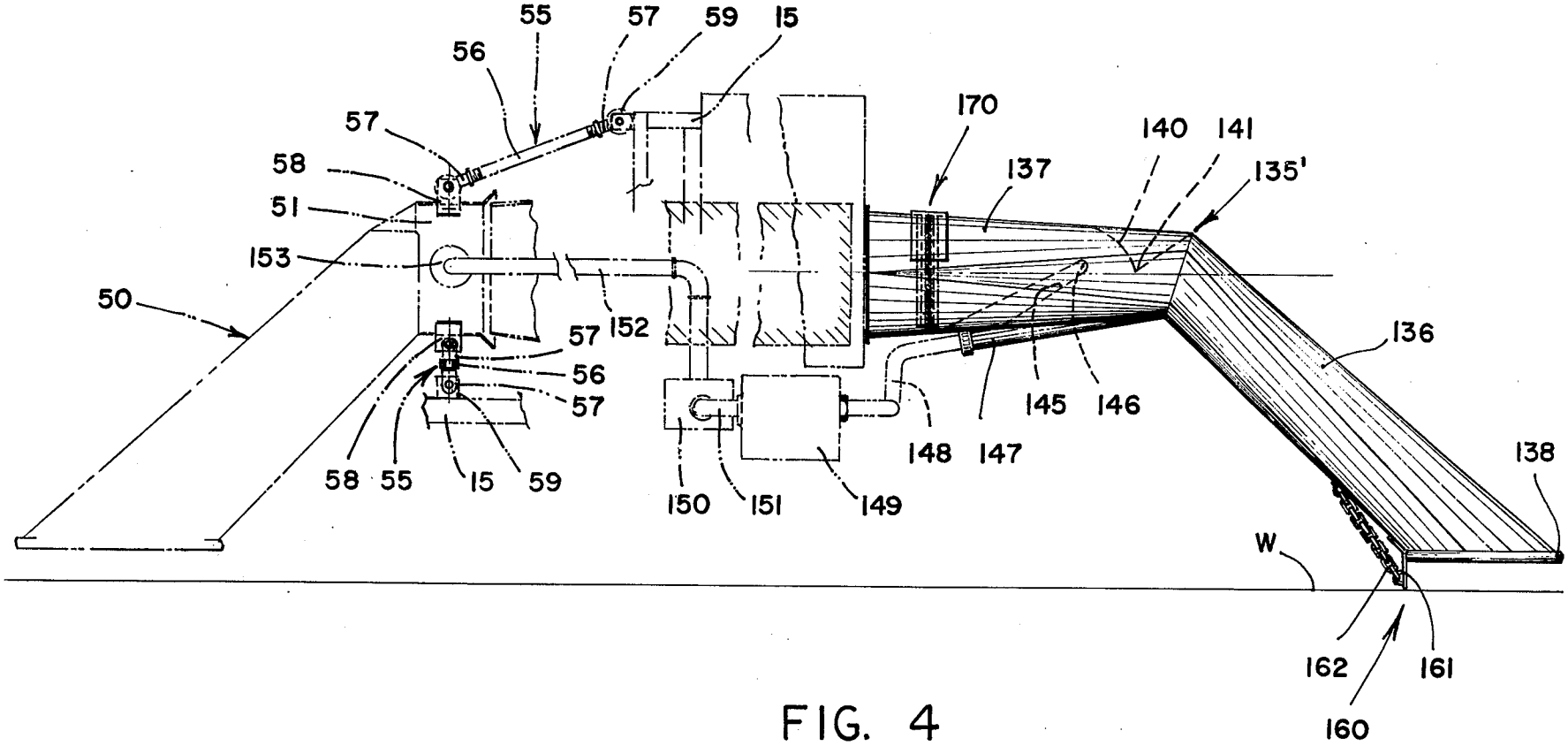
FIG. 4 is a side elevational view, in section, depicting the alternate form of intake duct of FIG. 1 of the drawings with associated portions of the apparatus shown in chain lines.
Figure 6:
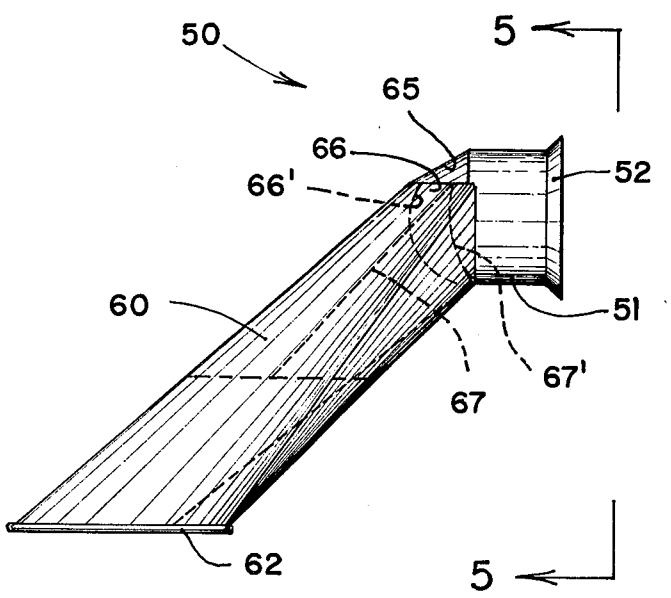
FIG. 6 is a side elevational view of the exhaust duct of FIG. 5 showing additional features of the baffles and other elements.
Figure 5:
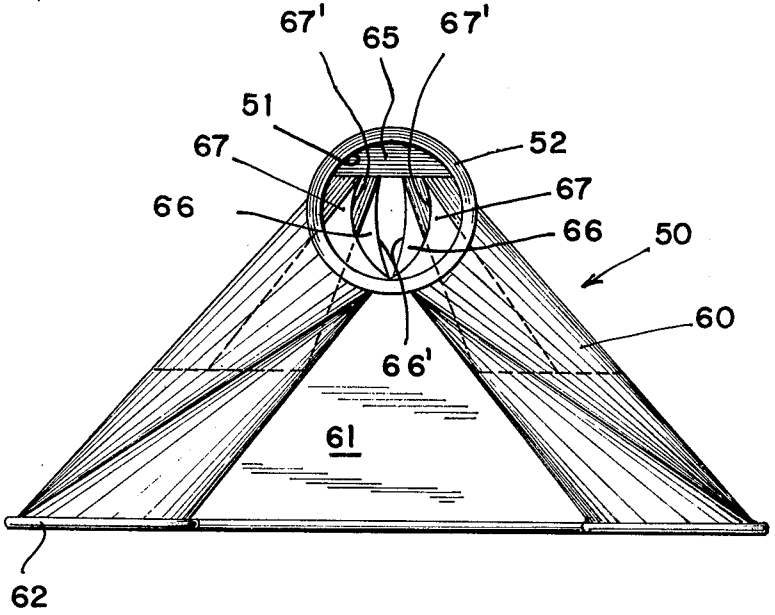
FIG. 5 is a rear elevational view taken substantially along the line 5—5 of FIG. 6 and showing particularly the baffle elements of the exhaust duct.

The intake air passing into jet engine 11 is processed in a normal operational manner and exits from the tail pipe portion 14 of the engine 11 in a highly expanded and heated state in the aftermath of engine combustion. In order to direct the high velocity heated air exiting from the tail pipe 14 of engine 11 into controlled incidence with a work surface W, the apparatus 10 is provided with an exhaust duct, generally indicated by the numeral 50. As seen in reference to FIGS. 1, 5 and 6, the exhaust duct 50 has an entry cylinder 51 which is preferably of a diameter substantially identical to the diameter of tail pipe portion 14 of engine 11. The extremity of entry cylinder 51 which abuts the end of tail pipe portion 14 has a flared peripheral flange 52. The flared peripheral flange 52, when the exhaust duct 50 is appropriately positioned, encompasses the tail pipe portion 14 of engine 11 but is preferably spaced a slight distance therefrom about the entire periphery although lying proximate thereto. This proximate mounting of exhaust duct 50 relative to engine 11 is significant for purposes of reducing the possibility of damage to tail pipe portion 14 in the event the exhaust duct 50 should be accidentally driven into engagement with another vehicle or other solid object. In addition, the spacing between peripheral flange 15 and tail pipe portion 14 permits, depending upon the extent of spacing, entry of a limited extent of outside air in the event of inordinately hot exhaust temperatures. This proximate but spaced mounting can be effected by flexural mounts 55 seen in FIGS. 1 and 4. Each of the mounts 55 consists of a central rod 56 threadably fitted at either end into omnidirectional couplers 57 which are restrained in brackets 58 and 59 mounted on the entry cylinder 51 and frame 15, respectively. The omnidirectional couplers 57 together with the natural flexural capability of the rods 56 provide a firm yet limitedly resilient attachment of the exhaust duct 50 relative to the tail pipe portion 14 of engine 11.

Extending from the entry cylinder 51 of exhaust duct 50 and providing the diffusion of air over a substantial area of work surface W is an exhaust distributor indicated by the numeral 60. The exhaust distributor 60 is of generally prolate truncated conical configuration outwardly of the trailer 20 with the side closest to the trailer 20 being a reverse curved portion 61 such that the width of the bottom output opening in exhaust distributor 60 is of a substantially uniform dimension in the direction of travel of the trailer 20. For purposes of imparting additional rigidity and strength to exhaust distributor 60 the lower edge defining the output opening may have a tube 62 or other reinforcing member (see FIGS. 5 and 6).

In order that the exhaust distributor 60 may provide substantially equivalent air flow across the entire lateral extent of the output opening defined by tube 62, provision must be made for diffusing the exhaust air internally of the exhaust distributor 60 due to the extreme velocity of the air exiting the tail pipe portion 14 of engine 11. To this end the exhaust distributor 60 has a deflector plate 65 positioned upwardly at the juncture between entry cylinder 51 and exhaust distributor 60. The lateral distribution of exhaust air subsequent to the downward deflection by deflector plate 65 is effected by a pair of medial baffles 66 which are flanked outwardly thereof by lateral baffles 67 (see FIGS. 5 and 6). The baffles 66 and 67 are generally positioned along the flow path of a fluid traversing between entry cylinder 51 and the output opening defined by tube 62 of exhaust distributor 60. In order to effect greater equalization of fluid flow in the longitudinal compartments formed between the various baffles 66 and 67, the leading edges 66' and 67' of baffles 66 and 67, respectively, are preferably curvilinearly undercut such as to form a somewhat cylindrical pocket at the juncture between entry cylinder 51 and exhaust distributor 60.

The angularity of exhaust distributor 60 relative to the entry cylinder 51 is based upon a balance between conflicting factors. The greater the deflection angle of fluids passing from tail pipe portion 14 down to the exhaust distributor 60 the greater is the loss in exhaust velocity from the opening defined by tube 62 which operates on a work surface. Relatedly, the lesser the downward deflection angle caused by orientation of the exhaust distributor 60 the greater the size of the exhaust distributor 60 to reach an equivalent position proximate a work surface. A downward angularity of approximately 45° between the entry cylinder 51 and exhaust distributor 60 has been found to constitute an appropriate balance between these factors in maintaining the velocity of the exhaust air while minimizing the size of the exhaust distributor 60. Thus directed, impressive drying characteristics can be realized from the exhaust of jet engines of the type hereinabove referred to. With a jet engine operating at only a fraction of its output capability, high velocity air quantitatively in excess of 100,000 cubic feet per minute and in excess of 1,000° F. can be brought to bear over an area on the order of 35 to 50 square feet, thereby producing substantial convection drying capabilities as well as a heat source providing millions of BTU's per hour.

For purposes of channeling air from a different source location for certain applications, the apparatus may assume a modified form as described hereinafter. The alternate embodiment involves the intake duct 35 and contemplates an intake scoop, generally indicated by the numeral 135'. Intake scoop 135' is particularly advantageous in applications of the apparatus 10 wherein it is desired to employ the air intake to supplement the moisture drying characteristics of the exhaust duct 50. In particular, excessive moisture accumulations may be substantially diminished by the intake scoop 135' in relation to paved or other substantially flat surfaces on which quantities of moisture may pool or puddle. The intake scoop 135' may have a receiver duct 136 which may be configured similarly to the exhaust distributor 60 of the exhaust duct 50. The receiver duct 136 is angularly joined with an entry conduit 137 which is adapted for joinder to the air intake portion 13 of engine 11. The other extremity of receiver duct 136 may have a peripheral tube 138 for reinforcement purposes comparable to the tube 62 of the exhaust distributor 60.

Separation of moisture from moisture laden air introduced through receiver duct 136 can be facilitated by strategically located baffle elements in the entry conduit 137. As seen, the entry conduit 137 has proximate the top thereof a deflecting baffle 140 which tends to deflect the fluids passing therethrough downwardly within entry conduit 137. As shown, the deflecting baffle 140 has a projecting extremity 141 which extends laterally of the entry conduit 137 from side to side. Between the deflecting baffle 140 and the air intake portion 13 of the engine 11, an upstanding fluid entrapment baffle 145 also extends transversely of the entry conduit 137 upwardly from the bottom thereof. The upper extremity 146 of baffle 145 is preferably located at substantially the same height within entry conduit 137 as the projecting extremity 141 of deflecting baffle 140 such that lighter moisture free air passing around deflecting baffle 140 by its tendency to rise passes over entrapment baffle 145 and into the engine 11. Contrastingly, heavier moisture laden air which is deflected downwardly by deflecting baffle 140 tends to engage the entrapment baffle 145 with the moisture content being scrubbed therefrom such as to leave a moisture deposit in a drain pan 147 formed in the lower surface of entry conduit 137.

Water collected in the drain pan 147 may be disposed of by gravity drainage through a conduit 148 connected to a storage tank 149 which may be mounted at any convenient location on the trailer 20 or associated components. If desired, a water disposal system could be provided to minimize the size of the storage tank 149. Such a disposal system could take the form of a pump 150 having an inlet conduit 151 from the storage tank 149 and an outlet conduit 152 leading to a spray fitting 153 located in the entry cylinder 51 of the exhaust duct 50. Water expelled through the spray fitting 153 into the entry cylinder 51 would immediately flash into steam and pass with the exhaust air exiting the engine 11. Thus, if desired, provision may be made for either storage or continual disposal of water accumulated in the drain pan 147.

Although the high velocity entry of on the order of 20,000 to 40,000 cubic feet per minute of air through the intake scoop 135' provides substantial lifting force for moisture on a work surface W (FIG. 4) proximate the opening defined by tube 138, the pick up of water may be facilitated by a scrubbing device, generally indicated by the numeral 160. The scrubbing device 160 may be constituted of an extending blade 161 having the upper extremity attached to the receiver duct 136. The blade 161 may be made of any number of elastomeric materials having reasonable rigidity but sufficient flexibility to accommodate surface irregularities in work surface W. The blade 161 reposes in contact with and preferably substantially perpendicular to the work surface W such as to operate in the manner of a squeegee in gathering water at the leading surface thereof during movement of the trailer 20 in a position to be lifted into the receiver duct 136 of intake scoop 135'. In order to prevent undue distortion of the blade 161 when the trailer 20 is backed or otherwise maneuvered, the blade 161 may have a restraining chain 162 attached rearwardly thereof and to the receiver duct 136 such that the blade 161 cannot be deflected substantially forwardly of the perpendicular position depicted in FIG. 4 or possibly drawn up against the opening defined by tube 138.

In addition to the advantageous moisture removal characteristics of the intake scoop 135', such is also subsidiarily useful for the removal of debris from a work surface W particularly in the instance of race tracks where plastic, metal or other particles can accumulate with perhaps dangerous results. Since such debris would also be dangerous to a jet engine, it is significant that such materials be collected without significantly adversely affecting the quantitative intake of air to the engine 11. For this purpose, the intake scoop 135' may be provided with a debris accumulator, generally indicated by the numeral 170 as seen in FIGS. 1–4, inclusive. Of greater sophistication than the screen 45 of intake stack 35' the accumulator 170 is preferably configured for ready access for removal of substantial quantities of debris. Such may be accomplished by configuring a portion of the accumulator 170 as an arcuate segment 171 of the entry conduit 137. Suspended from the segment 171 are a plurality of rods 172 which are preferably alternately offset longitudinally of the entry conduit 137. The rods 172 are supported at their lower end by a plate 173 which reposes within the entry conduit 137. The alternate offset of the rods 172 with a mesh screen 175 interposed therearound produces a corrugated screen configuration characterized by a plurality of intermittent ridges and furrows. An accumulator 170 thus configured may be readily removed from the intake scoop 135' and debris removed therefrom or from the portion of the entry conduit 137 proximate thereto. Since in this instance substantial accumulations of debris could be expected in some environments, the greater surface area afforded by the corrugated configuration permits the accumulation of substantial quantities of small articles of debris without producing deleterious effects upon operation of the engine 11 due to air starvation.

I claim:

1. Apparatus for directionally controlling the movement of high velocity air in relation to a work surface comprising, mobile support frame means, jet engine means having an elongate tubular housing attached to said support frame means, air intake means at one axial extremity of said tubular housing, tail pipe means at the other axial extremity of said tubular housing, and exhaust duct means mounted proximate said tail pipe means and directing high velocity air into impingement with the work surface from a position proximate thereto, said exhaust duct means being firmly mounted proximate said tail pipe means by flexural mounts providing a limited resilient attachment protecting said tail pipe means.

2. Apparatus according to claim 1 wherein said exhaust duct means is mounted proximate said tail pipe means by flexural mounts.

3. Apparatus according to claim 1 wherein said exhaust duct means has an entry cylinder having a diameter substantially identical to the diameter of said tail pipe means of said tubular housing and a flared peripheral flange mounted on the extremity of said entry cylinder proximate to but spaced from said tail pipe means.

4. Apparatus for directionally controlling the movement of high velocity air in relation to a work surface comprising, mobile support frame means, jet engine means having an elongate tubular housing attached to said support frame means, air intake means at one axial extremity of said tubular housing, tail pipe means at the other axial extremity of said tubular housing, and exhaust duct means mounted proximate said tail pipe means and directing high velocity air into impingment with the work surface, said exhaust duct means including a distributor of generally prolate truncated conical configuration for diffusing air over a substantial area of the work surface, said distributor having baffles extending in the direction of air flow in said exhaust duct means to effect equalization of air flow over the work surface area and having leading edges which are undercut to form a generally cylindrical pocket furthering the equalization of air flow in compartments formed between said baffles.

5. Apparatus according to claim 4 wherein said distributor is connected to an entry cylinder and a deflector plate is located at the juncture therebetween.

6. Apparatus for directionally controlling the movement of high velocity air in relation to a work surface comprising, mobile support frame means, jet engine means having an elongate tubular housing attached to said support frame means, air intake means at one axial extremity of said tubular housing, tail pipe means at the other axial extremity of said tubular housing, elongate intake duct means communicating with said air intake means obtaining air at a position displaced radially of said tubular housing means of said jet engine means, said elongate intake duct means having an upstanding intake stack means extending a substantial distance above the work surface and terminating in an extremity having an elongate rectangular cross-sectional area, and exhaust duct means mounted to receive high velocity air discharged from said tail pipe means and to direct high velocity air into impingement with the work surface.

7. Apparatus according to claim 6 wherein said elongate intake duct means is an upstanding intake stack means extending a substantial distance above the work surface.

8. Apparatus according to claim 6 wherein said intake stack means is of substantially constant cross-sectional area perpendicular to the direction of air flow therethrough throughout its length.

9. Apparatus according to claim 8 wherein said intake stack means has a chimney section, transition section and cylindrical section, said cylindrical section being attached to said air intake means of said jet engine means.

10. Apparatus according to claim 8 wherein said intake stack means is formed of sheet material having a reinforcing flange at the opening thereof to prevent deflection.

11. Apparatus for directionally controlling the movement of high velocity air in relation to a work surface comprising, mobile support frame means, jet engine means having an elongate tubular housing attached to said support frame means, air intake means at one axial extremity of said tubular housing, tail pipe means at the other axial extremity of said tubular housing, elongate intake duct means communicating with said air intake means obtaining air at a position displaced radially of said tubular housing means of said jet engine means, and exhaust duct means mounted to receive high velocity air discharged from said tail pipe means and to direct high velocity air into impingement with the work surface, said intake duct means including scoop means having an opening displaced from said exhaust duct means and positioned proximate the work surface to provide supplemental moisture drying.

12. Apparatus according to claim 11 wherein said scoop means has a deflecting baffle and a fluid entrapment baffle for removal of water from air entering said scoop means.

13. Apparatus according to claim 12 wherein said scoop means has a drain pan proximate said baffles for collecting water.

14. Apparatus according to claim 13 including storage tank means and pump means for transferring the water to said exhaust duct means.

15. Apparatus for directionally controlling the movement of high velocity air in relation to a work surface comprising, mobile support frame means, jet engine means having an elongate tubular housing attached to said support frame means, air intake means at one axial extremity of said tubular housing, tail pipe means at the other axial extremity of said tubular housing, elongate intake duct means communicating with said air intake means obtaining air at a position displaced radially of said tubular housing means of said jet engine means, said intake duct means including scoop means having removable accumulator means therein for collecting debris, and exhaust duct means mounted to receive high velocity air discharged from said tail pipe means and to direct high velocity air into impingement with the work surface.

16. Apparatus according to claim 15 wherein said accumulator means includes a corrugated screen configuration.

17. Apparatus according to claim 16 wherein said scoop means has scrubbing means for engaging water on the work surface to facilitate entry into said scoop means.

* * * * *